US007745711B2

(12) United States Patent
Kerns et al.

(10) Patent No.: US 7,745,711 B2
(45) Date of Patent: Jun. 29, 2010

(54) PAN MUSICAL INSTRUMENTS AND METHODS FOR MAKING SAME

(76) Inventors: Ronald G. Kerns, 2536 Johnnycake Rd., Mogadore, OH (US) 44260; Steven C. Lawrie, 2445 Thurmont Rd., Akron, OH (US) 44313; Angeline Lawrie, 2536 Johnycake Rd., Mogadore, OH (US) 44260; Ronald J. Drouin, 102 Merriman Rd., Akron, OH (US) 44303; David R. Gettes, 839 Surrey La., Media, PA (US) 19063

( * ) Notice: Subject to any disclaimer, the term of this patent is extended or adjusted under 35 U.S.C. 154(b) by 101 days.

(21) Appl. No.: 12/101,629

(22) Filed: Apr. 11, 2008

(65) Prior Publication Data

US 2009/0178537 A1 Jul. 16, 2009

Related U.S. Application Data

(60) Provisional application No. 60/911,174, filed on Apr. 11, 2007.

(51) Int. Cl.
*G10D 13/00* (2006.01)

(52) U.S. Cl. ..... 84/402; 84/419; 84/411 R

(58) Field of Classification Search ..... 84/411 R, 84/419, 406

See application file for complete search history.

(56) References Cited

U.S. PATENT DOCUMENTS

| | | | | | |
|---|---|---|---|---|---|
| 4,466,329 | A * | 8/1984 | Hayward | 84/406 |
| 5,973,247 | A * | 10/1999 | Matthews | 84/402 |
| 6,212,772 | B1 * | 4/2001 | Whitmyre et al. | 29/896.22 |
| 6,750,386 | B2 * | 6/2004 | King | 84/411 R |
| 7,030,305 | B1 * | 4/2006 | Cupid | 84/411 R |
| 7,307,205 | B2 * | 12/2007 | Balma et al. | 84/411 R |
| 7,310,866 | B2 * | 12/2007 | Balma et al. | 29/446 |
| 7,402,739 | B2 * | 7/2008 | Balma et al. | 84/411 R |
| 7,473,835 | B2 * | 1/2009 | Balma et al. | 84/411 R |
| 7,560,632 | B1 * | 7/2009 | Lanzel et al. | 84/411 R |
| 2006/0156898 | A1 * | 7/2006 | Nickel | 84/411 R |
| 2009/0013851 | A1 * | 1/2009 | Copeland | 84/411 R |
| 2009/0178537 | A1 * | 7/2009 | Kerns et al. | 84/411 R |

OTHER PUBLICATIONS

Kronman, Uif, "Steel Pan Tuning" Published by Musikmuseet, Copyright 1991, Jan. 1992. chaps. I and II; web site www.hotpans.se/pan/tuning/index.php, viewed Sep. 21, 2009.*

* cited by examiner

*Primary Examiner*—Jeffrey Donels
*Assistant Examiner*—Robert W Horn

(57) ABSTRACT

The invention provides pan musical instruments, or pans, and methods of making same. Particularly, a process for mechanization and mass production of tunable pans with improved consistency, sound quality, and ease of tuning is provided.

6 Claims, 7 Drawing Sheets

PAN MUSICAL INSTRUMENTS AND METHODS FOR MAKING SAME

FIELD OF THE INVENTION

The present invention relates to pan musical instruments and methods of making same. Particularly, a process for mechanization and mass production of tunable pans with improved consistency, sound quality, and ease of tuning is provided.

BACKGROUND OF THE INVENTION

Pan musical instruments are a family of pitched percussion instruments originating from the island of Trinidad in the late 1930s. Pans may come in various voices/instruments representing, among others, soprano, alto, tenor, and bass. Each voice has a plurality of note facets shaped on the playing surface. The quantity of note facets may vary from one to thirty or more, depending on the range, diameter, and number of drums for any particular instrument.

Pans have traditionally been hand crafted from 55 gallon 22.5" diameter industrial metal containers/barrels, and most pans currently made are still hand hammered from such containers/barrels. The top and bottom heads of such barrels ordinarily consist of 18 gauge steel of unspecified composition and hardness. These heads are shaped into a concave bowl using large hammers. With smaller hammers, note facets are then shaped based on a small number of rough measurements incorporating non-precise measuring techniques and devices. The skirt, or sidewall, for the pan is then cut from the barrel to the desired length. Skirt length varies depending on the desired register or voice of the pan (soprano, alto, tenor, or bass). The pan is then heat treated, cleaned, and prepared for tuning. The tuning process is performed using a series of small hammers, a strobe tuner, and many hours of focused concentration by a skilled craftsman. After tuning, the pan is painted or chrome plated in order to prevent corrosion. The instrument then undergoes a final tuning in a suspended position similar to its position when being played.

The traditional process outlined above generally requires many hours to create an instrument, and can take as many as one hundred eighty hours or more depending on the instrument voice and the skill of the craftsman. This lengthy process has made it difficult for the industry to meet the current market demand for such instruments. Further, such traditional pans and pan-making processes suffer several disadvantages.

First, one rate limiting step in the mass production of high quality pans has been the starting material, namely, the 55 gallon oil barrel. The type of material used to produce an industrial container, normally 18 gauge cold rolled steel of unspecified composition, hardness, and varying thickness, does not yield a consistent or high quality pan. The variation in the steel from barrel to barrel requires the craftsman to incorporate varying methods of building and tuning. This greatly increases the amount of time required to produce a pan instrument and sometimes is not physically possible to achieve success.

Second, the standard 22.5" diameter industrial barrel presents several major problems and limitations. This diameter does not provide sufficient surface area for a complete layout of optimal size note facets, thereby requiring the craftsman to reduce the size of the note facets in an attempt to produce an instrument with a maximal tonal range. Unfortunately, shrinking the note facets compromises sound quality, requires longer tuning time, and results in far less stable notes. Stability as used herein refers to a combination of how well a note can reproduce its intended frequency when struck at varying velocities with a mallet, and how long the note will remain in tune. The inventors herein have discovered that larger note facet sizes produce cleaner and more stable frequencies on each note facet, and therefore, one aspect of the invention provides a larger diameter starting material which accommodates larger note facets. Expanding the size of the starting material has made it possible to increase the note sizes as well as the amounts of interstitial material surrounding each note facet, resulting in significantly better sounding notes while maintaining or exceeding the tonal pitch range of conventional pans.

Third, the manner in which the head is customarily attached to the sidewall or skirt, via crimping, creates additional problems found in most, if not all, instruments built from industrial containers. The rim formed by this crimping process tends to separate slightly during the initial hammering phase, i.e., the sinking and shaping of the bowl, causing the rim notes to be loose and raspy. On many pans, this causes a buzzing sound when playing the rim notes. Further, the use of seaming compound, an adhesive filler material placed between the head and sidewall prior to crimping, adds to these problems. When the pan is annealed (i.e., heat treated) the compound tends to melt and flow, leaving metal to metal junctions inside the crimped rim causing additional buzzing and looseness. These problems are exacerbated each time the instrument is retuned and are difficult to eliminate without negatively affecting other sound characteristics. This commonly recognized, but until now, unresolved problem results directly from use of starting material designed to be an industrial container, rather than a musical instrument.

A further disadvantage prevalent in traditional pans is that the shaping of the material within the pan has generally been achieved by approximation and eye-balling, without an appreciation for and/or precise application of the physics and geometry required to produce consistent pans of high acoustic clarity and optimal harmonic and timbre characteristics. Lack of precise bowl shape, note shape, and insufficient interstitial geometry all decrease the dynamic range, clarity, and stability of the instrument, and necessitate frequent and expensive retuning.

Mass Production Problems

Presently, production time for creating pans from industrial barrels remains dependent on the skill of the craftsman. There exists a lack of reproducibility from start to finish in the production of pans globally. The quality of the instrument has been substandard in comparison to other musical instruments. The cost for hand crafting has also caused the prices of pans to exceed what most consumers including schools, individuals, and professionals, can afford. Previous attempts to mechanize the process have not been successful from an economic, efficiency, or quality standpoint. Using an existing hand crafted pan as a model will only produce the same problems and poor quality, albeit on a larger scale.

For example, U.S. Pat. No. 6,212,772 discloses recent attempts to mechanize the production process using hydro forming. This process yields non-tunable, essentially unusable pans. The male mold was modeled after an existing hand crafted model. During hydro forming, the disc is formed over the male punch, not stretched into shape as during the pressing/stamping process of the present invention. This lack of stretching and tensioning yields a pan that is virtually untunable.

The art, therefore, is in need of improved processes for producing pans of higher quality and in a reproducible fashion.

SUMMARY OF THE INVENTION

Years of extensive research and development have enabled the inventors herein to design and build a blank and form die used to stamp/press tunable pan drum blanks. This mass production process has eliminated much of the hand labor required to produce a pan, and has contributed to improved consistency, repeatability, and quality. The understanding of the physics and geometry regarding bowl shape, note shape, and note placement has yielded a die designed through mathematical modeling, not through copying an existing hand crafted model. The present invention also provides the understanding that the particular composition of the starting material is one factor in producing an instrument of superior quality that remains in tune longer than pans made from industrial containers.

The quality and stability of individual notes, as well as the quality of the entire instrument, result from the interplay of several factors including but not limited to: construction and compositional properties of the starting material; shape and size of the pan bowl; arrangement, orientation, shape and size of the note facets; as well as shape, smoothness, tightness, and the amount of interstitial material surrounding all notes.

Discovering the advantages of larger note sizes mitigated in favor of a larger diameter starting material. Expanding the size of the starting material has allowed an increase in the note sizes, creating better sounding notes and overall instruments, while maintaining or exceeding the tonal pitch range of conventional pans. Additionally, the invention herein is adaptable to pans of a variety of sizes, allowing for the construction of pans which are sized in accordance with the desired tonal pitch range of the pan. Thus, larger pans will accommodate a broad range of pitches in the lower registers, while upper register pans may be produced in a smaller size appropriate for that range.

In general, in one aspect, the method of the invention provides a process for the mechanization of pan building. The method generally begins with a die loaded into an industrial multi-ton stamping press. A substrate, such as squares of steel or other type materials such as but not limited to, brass, aluminum, stainless steel, alloys thereof, and the like, are fed into the press. The press cycles and the die stamps a pan blank. The blank is removed from the press, and is ready for finishing and tuning. At this stage, the blanks resemble a finished pan, but the blanks made by the present invention are produced in seconds, rather than the hours required by traditional methods. Not only are they produced more efficiently, they are also dimensionally more precise, more accurate, and the note facets, as well as the interstitial steel around the note areas, are smoother and more defined. Moreover, unlike other methods previously attempted, the present invention's stamping process yields pan blanks which gradually thin from the rim toward the center, thereby providing the blank with regions appropriate for different pitches, i.e., lower notes placed in the distal regions of the pan and higher notes placed toward the center.

In another aspect of the invention, note facets are provided with a larger size, and may be more optimally shaped in an elliptical manner, allowing for notes which can reproduce the fundamental frequency in a majority of the note facet, but with octaves found on the terminal regions of the long axis and harmonics found on the terminal regions of the short axis.

In yet another aspect, the invention provides greater interstitial material surrounding the note facets, thereby conferring more isolated notes and the concomitant advantages of cleaner and more stable notes.

In another embodiment, the invention provides for the design of differently sized pans with note facet layouts having optimal arrangements, allowing for different pitch range pans to have different sizes in accordance with the optimal size for such pitch ranges.

These characteristics, properties, and improvements allow reproducibility of a tuning protocol and produce an instrument with better note isolation, more precise harmonic overtones, and more balanced timbre throughout the instrument. The process disclosed herein allows those of skill in the art to create virtually identical pans, made with the same desirable material and exhibiting precision tolerances in bowl shape, note shape, and interstitial material, unmatched elsewhere in the art. Importantly, these tunable blanks are virtually identical to one another. The tuning process is therefore more controlled and consistent, allowing for far more rapid tuning, and also providing an improved ability to train new tuners in the process. The larger scale of production enabled by the present invention also allows for the provision of tunable blanks to professional and amateur tuners throughout the world. In short, the present invention allows for the mass production of the highest quality tunable pans in the art form today.

Thus, in one aspect, the invention provides a process for making a tunable pan musical instrument, comprising the step of stamping a substrate into a pan head in a press with a die to produce a desired bowl size and shape, and note shape and placement.

In another aspect, the process further comprises the step of attaching a sidewall to the pan head to produce a pan. The process may further comprise the step of finishing the pan, as well as the step of tuning the pan.

In another aspect, the die is designed to produce a pan having at least one feature selected from the group consisting of optimal size, optimal shape, optimal note facet size, optimal note facet shape, and optimal note facet layout.

In yet another aspect, the pan head has a thickness gradually increasing from the center outwards.

The invention also includes pans produced by any of the processes of the invention.

Other objects and advantages of the present invention will become apparent to those skilled in the art from a review of the ensuing description and figures.

DETAILED DESCRIPTION OF THE INVENTION

Figure 1:
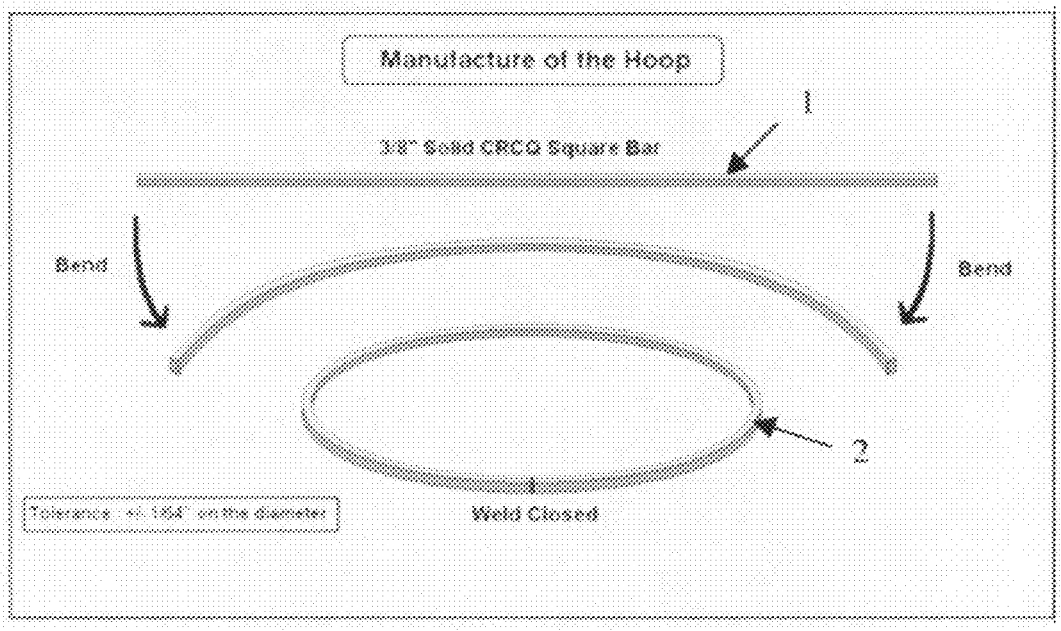
FIG. 1. depicts a schematic view of an embodiment of the present invention for assembling the hoop.
Figure 2:
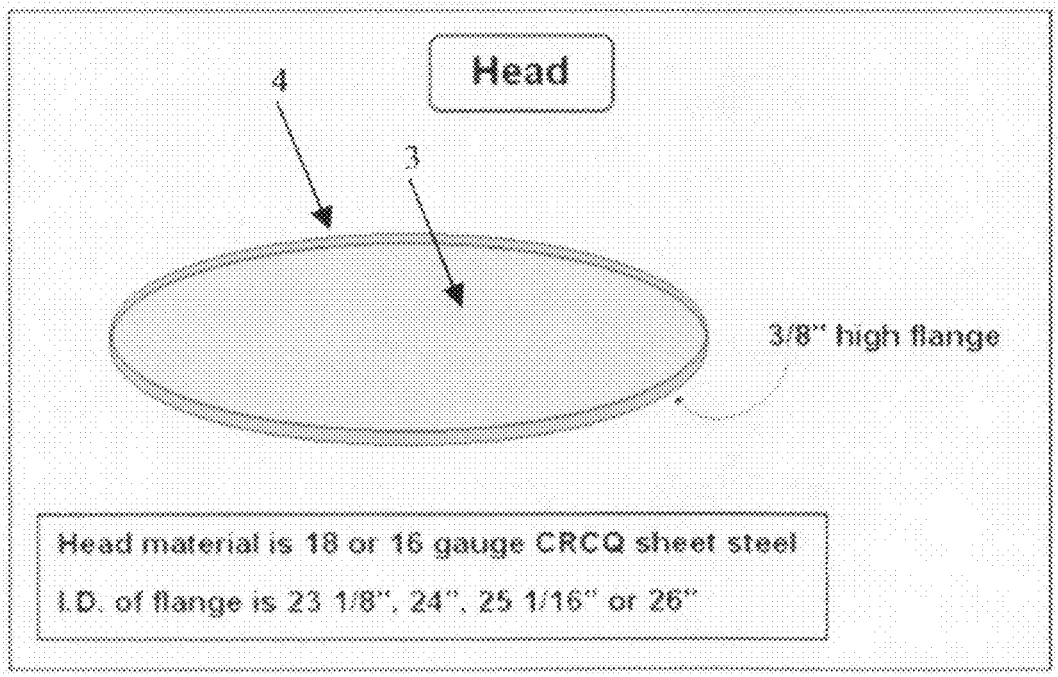
FIG. 2. depicts a schematic view of an embodiment of the present invention for assembling the head.
Figure 3:
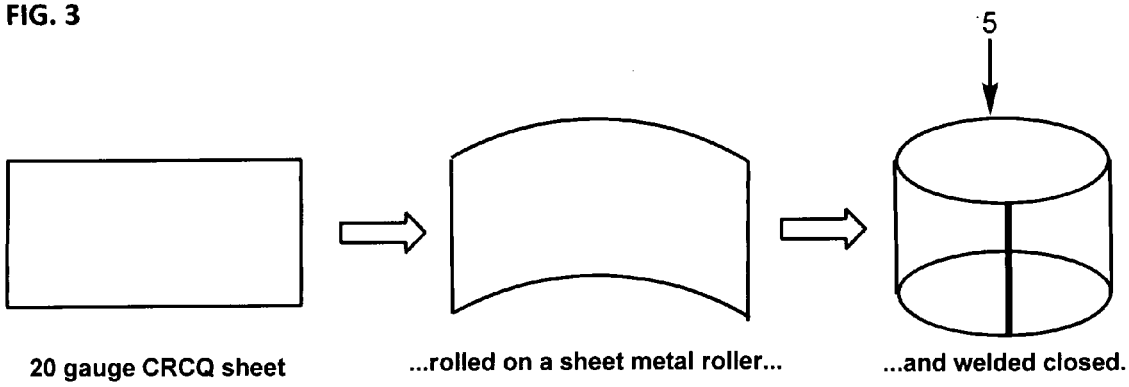
FIG. 3. depicts a schematic view of an embodiment of the present invention for assembling the skirt or sidewall.

The present invention provides methods of making pan musical instruments with improved efficiency, quality, reproducibility, and at a reduced cost. The invention also provides pans made by these methods, which pans have improved sound, consistency, note facet layouts, ease of tuning, and retention of tuning. Advantages of the present invention will be appreciated by those of skill in the art by reference to the following detailed description of embodiments.

1. Design of a Pan

A. Optimized Shaping of the Bowl and the Note Facets

A software program developed in-house, was used to mathematically calculate an optimal bowl shape for producing pans. This program differentiated the surface into an optimal space for note facets as well as interstitial material, and calculated an optimal bowl size and shape. All attempts at using an existing hand crafted pan to produce an appropriate digital model have failed. The relationship between the shape of the note facet and the curve of the bowl was further determined mathematically. An optimal interface, or angle of interstitial material surrounding the note facet, was also mathematically calculated.

The software program was also used to determine correct optimized note facet shapes and sizes. The inventors herein have discovered that the size of the note facet is dictated by the ability to tune the following frequencies; fundamental, first octave, and second octave, on the long axis; and an appropriate harmonic on the short axis. By incorporating a pseudo elliptical shape (an intersection of a cylinder with a sphere) for most note facets, as well as the proper geometric relationship of long and short axis, the tuning of the note facet has been simplified and requires less time. This design of the present invention also significantly reduces undesirable and incorrect harmonics, and results in increased dynamic range and a better "feel" or responsiveness when the pan is struck with a mallet.

It will be appreciated by those of skill in the art that while computerized design of optimal bowl shapes and note facet shapes, sizes, and layouts, may produce more optimal pan instruments, the invention is as easily adaptable to designs not produced by computer modeling. That is, the process of the invention is easily amenable to any desired pan size and note facet layout. As used herein, the term "optimal" or "optimized" when used in reference to bowl shape or size, or note facet shape, size, or layout, does not require that such elements be the mathematically most optimal, but simply that such elements have advantages over previous elements found in conventional pans. Thus, while certain embodiments of the invention provide for optimizing such elements, the production techniques disclosed herein are capable of mass producing pans of any desired size, shape, and note facet shape, size, and layout, enjoying the advantages of the technique in providing reproducibility, ease and speed of tuning, and other advantages described herein. Preferred embodiments, however, include elements of an optimized bowl and note facet elements.

B. Size of the Bowl

The optimized diameter of the pan is dictated by use of the correct note sizes and the maximum amount of interstitial material required for proper tuning and final timbre of each note. The amount of material between the rim and the back edge of the rim note is an important factor in sizing the bowl optimally. Using the proper diameter allows placement of the rim notes at least one inch below the rim. On ordinary pans, the diameter is too small to achieve sufficient spacing. This causes the rim notes to be butted up against the rim, which does not permit proper tensioning and shaping of the rim note, thereby yielding a less than optimal sound as well as limited dynamic range. In contrast to the conventional pan-making process, the present invention allows the production of pans with essentially any diameter, as determined by the desired pitch range to be produced. The pan production process is therefore no longer "locked in" to using the 22.5" diameter produced by the industrial container/barrel industry. Such diameter pans have suffered disadvantages in part because more notes are placed on the playing surface of such ordinary pans than that diameter will allow. This constraint limits the use of proper note sizes, and note facets are smaller than optimal, resulting in incorrect harmonics, out of tune pull (as described below), and out of tune and unstable pitches. The larger diameter pans of the present invention not only allow for more optimal note facet sizing and layout, but also allow for easier playability. The increased space additionally promotes ease of mobility around the playing surface.

C. Optimized Layout of Note Facets

On ordinary pans prior to the present invention, incorrect or random placement of neighboring notes produces conflicting and undesirable frequencies. This causes many, or even all, notes to sound out of tune due to sympathetic vibration from surrounding pitches. Also on ordinary pans, the higher octave notes are generally positioned directly in front of, or next to, the lower octave notes on the radial or tangential axis. This causes a conflict between the first and second octave of the low note with the fundamental and first octave of the high note, producing an undesirable and unpleasant sound. This conflict and the attendant disadvantages are referred to herein as "out of tune pull". On multiple barrel instruments, such as Double Tenor, Double Second and Cello, each pan has the notes positioned in the same configuration as the other barrels in the set. On ordinary existing pans, the note layout often varies on each barrel in the set. It is particularly difficult to achieve consistency of sound on two barrels that have individually varied note positioning, although the present invention even facilitates this possibility.

At least two factors are considered to determine the optimal layout, or positioning, of the note facets in the bowl of the pan. First, the relationship of neighboring fundamental frequencies and harmonics is a primary factor in the design of a quality pan. The proper neighboring frequencies greatly reduce and/or eliminate "cross talk" and "out of tune pull". Second, ease of playability is an important goal in the design of a quality pan. The pan should have sufficient forgiveness as to where the player strikes slightly off-center, such that the proper note is still sounded, and the layout should provide the player with economy of motion in playing successive notes.

In embodiments of the pans of the present invention, placing the second and third ring of notes in the channels between the rim notes greatly reduces or eliminates this "out of tune pull". The synchronized note positioning provided by the present invention, i.e., providing substantially similar note positioning on each pan of a multiple pan set, allows for easier scale passages, chording, key changes, and sticking (i.e., the pattern of playing a succession of notes with mallets held in hands), as well as consistency of sound quality.

2. Production of a Pan

A. Production of Dies

The following procedure may be used to generate an initial set of dies, however, those of skill in the art will appreciate that other techniques are useful to generate the desired head shape and size, and to create the dies necessary for stamping heads from same.

The inventors herein used computer software designed to calculate an optimal shape of the bowl, note facets, interface, and interstitial steel based on physics and geometry. However, the invention herein includes embodiments of pans which do not necessarily have optimal shapes of bowl and note facets, but do have the advantages of the production process used to produce the pans. That is, those of skill in the art will appreciate that a stamped pan blank will provide distinct advantages in producing pans regardless of whether the note facet shapes and layout are determined in accordance with such bowl and note shape aspects of the invention or otherwise.

A CAD model was generated, allowing the study of a variety of shapes, layouts, etc. The CAD model was used to produce a "Blue Wax" model of the playing surface including improved note shapes/sizes, optimal bowl shape, optimal note spacing, and optimal note layout. This wax model was cut and formed using a CNC milling center. The CAD model was then used to generate the specifications for cutting a block of tool grade steel for use as the male/female die set.

The materials used to create the male/female die set may be selected from suitable steels of sufficient hardness, for example, A-2 form steels and D-2 cutting steels, however, these steels are somewhat costly. Thus, where applicable, these dies may be brought to the thickness required for stamping using milder steel that still retains sufficient toughness and stability, such as 4140 steel, used as filler blocks. The materials are cut and formed with a CNC machine center as well as standard tool room equipment. The CNC machine center may be programmed and driven by CAD 2D, CAD 3D and a CNC cutting program. The tool may then be hardened, preferably at 56-58 RC (Rockwell C scale) on all forms and cutting steels. As is standard in the industry for hardening steel, the steel is drawn to reduce brittleness which comprises reheating for the desired time, and may be repeated, as in a double draw process, if desired.

B. The Head, Comprising the Bowl and Rim

The substrate material used for the blank bowl must be of suitable composition to produce a tunable pan having a plurality of note facets. Many varieties of materials are suitable for this purpose, including but not limited to cold rolled steel, stainless steel, brass, aluminum, other metals and alloys, ceramics, carbon fibers, fiberglass, and the like. While the inventors herein have produced quality pans using brass, aluminum, and stainless steel, other materials are also suitable. In a preferred embodiment cold rolled steel is used. For cold rolled steel, important elements to control include carbon content, sulfur content, hardness, and starting thickness. Other elements in the composition, including but not limited to, manganese and aluminum, may contribute to the overall quality of the resulting pan, and may be varied with varying results.

Proper starting thickness of the material is determined by the largest note facet to be found in each ring of notes. The larger note facets producing lower pitches generally require a thicker material than the smaller note facets which produce higher pitches. The stamping process achieves this differential thickness in the bowl by stretching the material as it draws. The pan material becomes gradually thinner towards the center of the blank. For example, for larger pans, the thickness by the rim ranges from about 0.1 to 0.02 inches, preferably from about 0.08 to 0.03 inches, more preferably from about 0.067 to 0.049 inches, while in the center ranges from about 0.08 to about 0.01 inches, preferably from about 0.06 to about 0.02 inches, more preferably from about 0.049 to 0.025 inches. These ranges will vary with different diameter pans.

Figure 5:
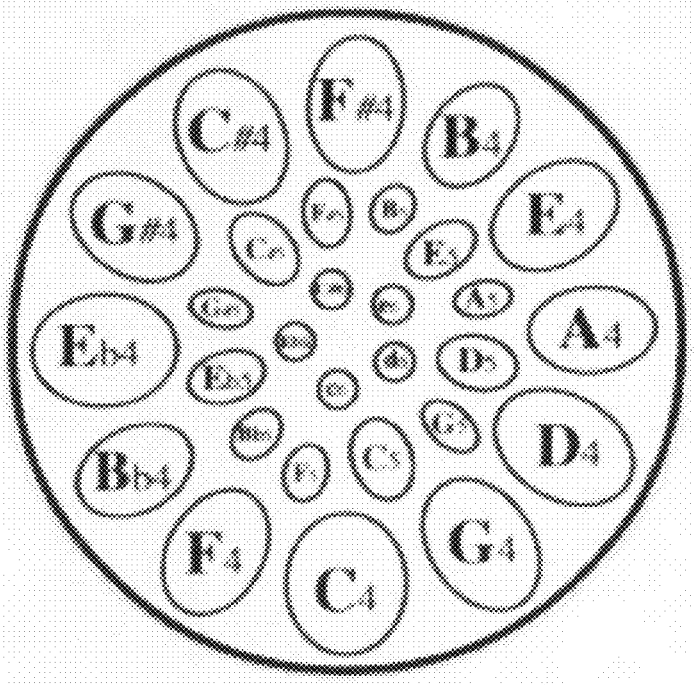
FIG. 5. depicts a schematic view of a 29 note facet layout in an embodiment of the present invention.
Figure 6:
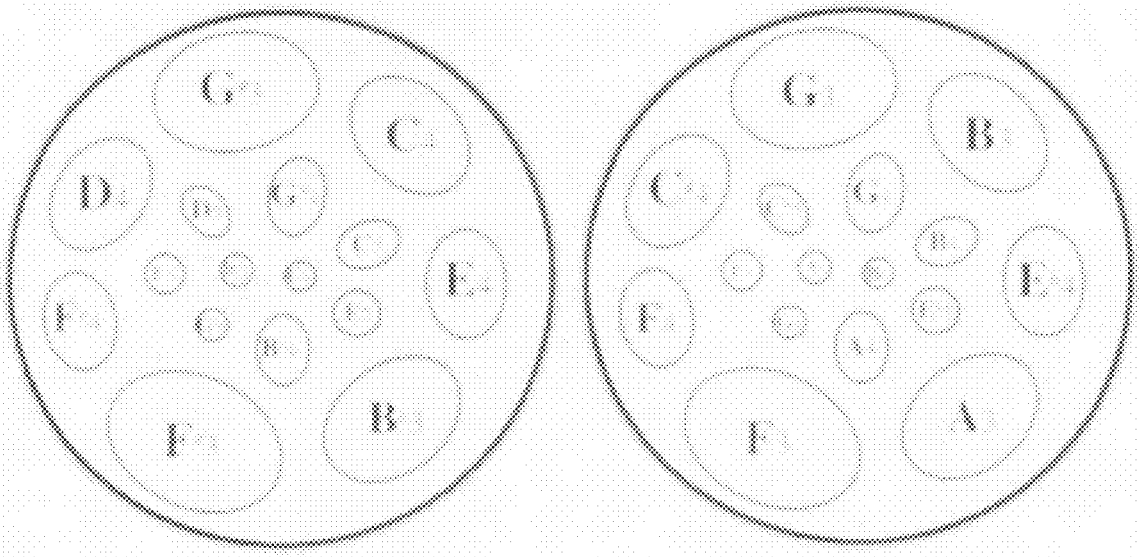
FIG. 6. depicts another schematic view of a 32 note facet layout on a two-drum set in an embodiment of the present invention.
Figure 7:
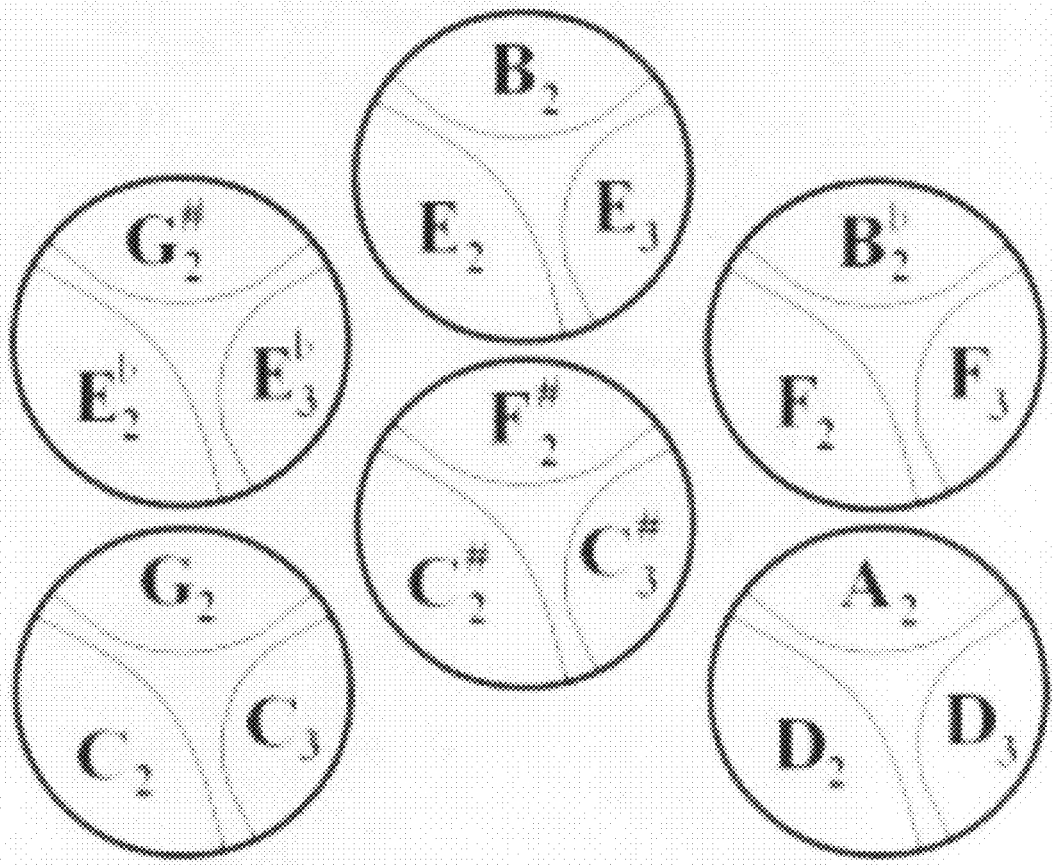
FIG. 7. depicts a schematic view of a 18 note facet layout on a six-drum set in an embodiment of the present invention.
Figure 8:
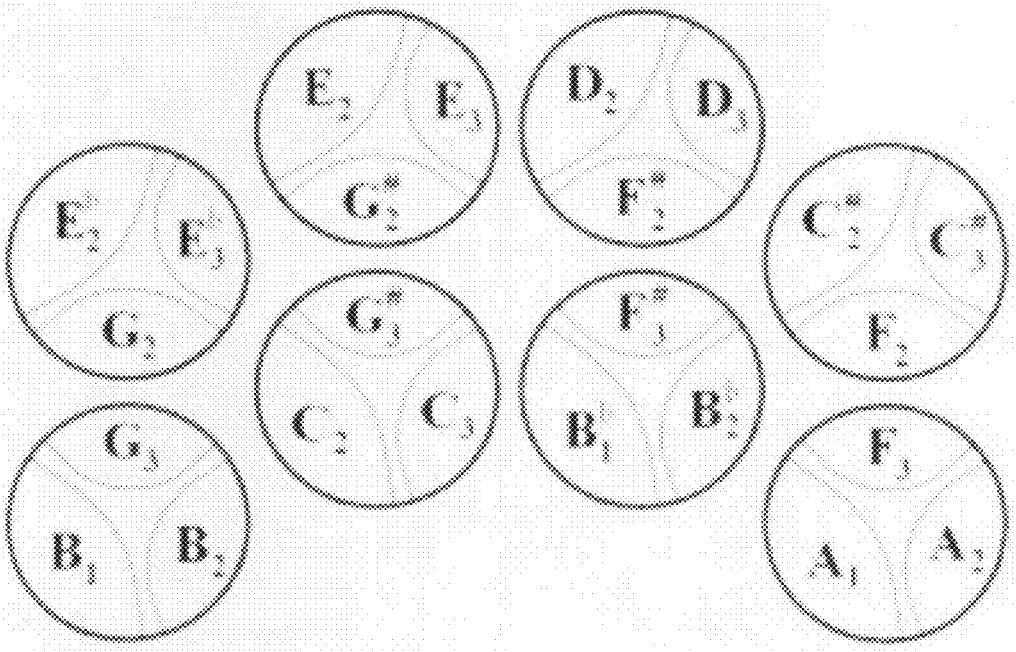
FIG. 8 depicts a schematic view of a 24 note facet layout on an eight-drum set in an embodiment of the present invention.
Figure 9:
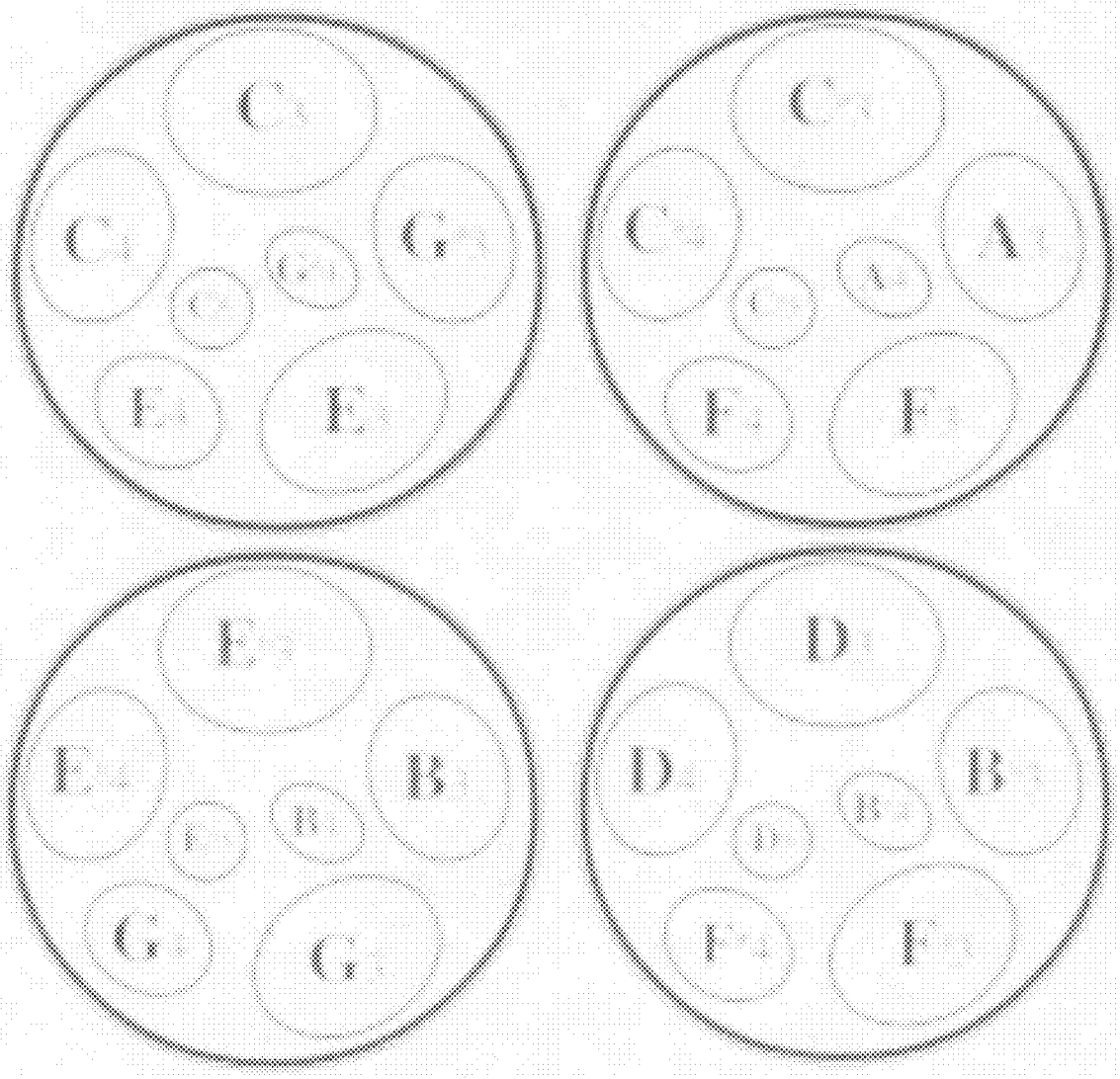
FIG. 9 depicts a schematic view of a 28 note facet layout on a four-drum set in an embodiment of the present invention.
Figure 10:
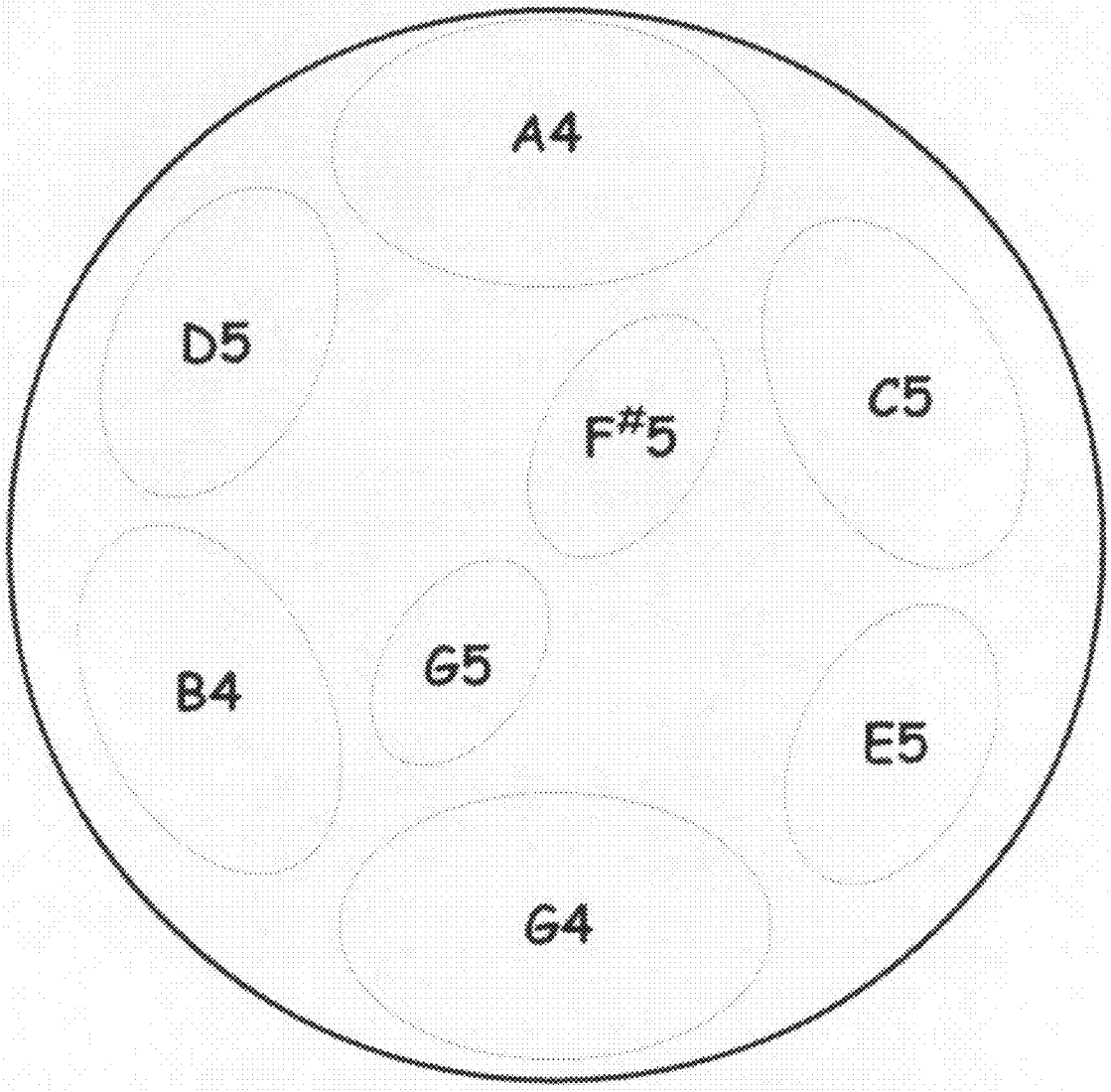
FIG. 10 depicts a schematic view of a 8 note facet layout in an embodiment of the present invention.

The blanks for tunable steel drum instruments are stamped using a stamping press of sufficient size, such as a 150 ton industrial stamping press. The size/type of press used will vary depending on the depth and diameter of the pan being produced as well as the type of material, however, this type of press is readily adaptable to stamping blanks of diameter 4 inches to 48 inches. Preferably, the blanks of the present invention range in diameter from about 10 to 36 inches, more preferably from about 15 inches to about 27 inches. One preferred embodiment provides a pan blank of diameter 15.75 inches, an example of which is shown in FIG. 10 and Example 1. Another preferred embodiment provides a pan blank of diameter 26.75 inches, an example of which is shown in FIGS. 5 and 6 and Examples 2 and 3.

The air cushion pressure generally varies from about 60-80 PSI depending on the type of material being stamped. The complete cycle time is approximately two minutes but will vary with the type of materials and press. It is recommended to coat each piece with draw lubricant prior to pressing.

C. Attachment of the Head to the Skirt or Sidewall

Figure 4:
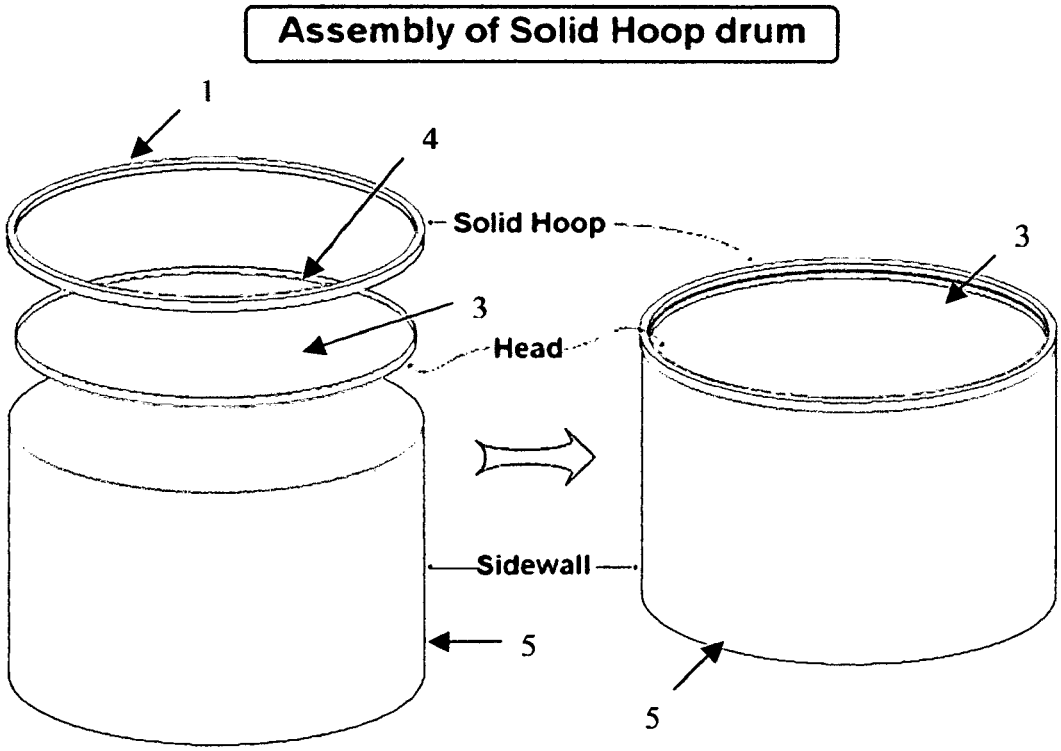
FIG. 4. depicts a schematic view of an embodiment of the present invention for assembling the completed pan.

With reference to the Figures, embodiments of the invention are further described herein. The inclusion of and the manner of attaching the head to the skirt or sidewall to complete a pan contributes in several ways to the quality of the finished pan instrument. Some embodiments of the present invention employ a one piece construction (see Example 1), while others employ a two piece construction (e.g., in a crimping process embodiment; see Example 3) or a three piece "solid hoop" construction (see Example 2). In the solid hoop embodiment, the sidewall (5) acts as a resonating chamber for the pitches on the drum head (3). See FIG. 4. The drum head and sidewall are formed from one piece of material with one male/female die stamping process. FIG. 1 shows a ⅜"× ⅜" square solid rod of steel (1) bent into a hoop (2) and welded closed. The preformed stamped blank is then welded to the inside edge of the hoop (2). A cylinder comprising proper predetermined material to be the sidewall (5) is rolled to size and then welded to the outside edge of the hoop. This solid hoop option adds mass to the rim, increasing stability and improving sound quality on larger diameter pans. The solid hoop rim also provides greater resistance to damage of the finished pan if dropped or bumped, as well as ease of cleaning between head and rim, which is difficult if not impossible on existing pans. These options of skirt attachment eliminate the possibility of a loose rim that causes buzzing, as well as tuning problems for the rim notes. Other methods of attachment include, but are not limited to, crimping head to skirt after formation of bowl and note facets, removable skirts attached via fasteners, bonding components via aggressive adhesives, and/or welding the skirt directly to the head.

The length of the sidewall/skirt is determined by the range of pitches to be comprised on the pan. Lower frequencies require longer skirts while higher frequencies require shorter skirts. The skirt length of the tunable pan blanks are calculated and optimized based on an understanding of the physics of sound and sound resonators in particular. The proper skirt length of the mechanized tunable blanks controls "skirt tone", resonance, and air column effect. Some voices require LFM's (Low Frequency Modifiers) to drive the air column skirt tone out of the range of that particular voice. Bass pans have a skirt length ranging from 17" to 45", more preferably 27" to 35". Cello pans have a skirt length ranging from 10" to 25", more preferably 12.5" to 17.5". Double Second pans have a skirt length ranging from 7" to 15", more preferably 9" to 11". Leads have a skirt length ranging from 2" to 10", more preferably 5" to 8". Jumbie Jam™ beginner's pans have a skirt length ranging from 1" to 5", preferably 2" to 3".

D. Annealing

Prior to finishing, the steel is generally heat treated in order for the notes to achieve proper timbre and sound quality during the tuning process. The pan is placed on a gas burner and heated to temperatures between 450 to 650 degrees Fahrenheit for approximately five minutes. Other methods of heat treating known in the art include but are not limited to tempering in an annealing oven, and direct heating over a wood fire or gas flame.

E. Finishing of the Pan

The pans made from cold rolled steel and other metals, including but not limited to stainless steel, require finishing to protect from rust and corrosion, as well as for cosmetic and aesthetic reasons. There are several accepted and proven ways known in the art. For example, chrome plating the entire pan, top, bottom, and side wall, is visually attractive as well as protective. The preformed blank must be polished and buffed. This is a multiple step process beginning with coarse abrasives and gradually reducing to a fine abrasive, including but not limited to sand paper or Scotchbrite™ type cleansing pads. The final process may use a series of buffing wheels coated with buffing compound. After polishing and buffing, the pan is cleaned and coated with nickel, approximately 7/1000 inch. The nickel is then coated with chrome, approximately 3/1000 inch. Another accepted method of coating the pan is to apply an automotive-type paint finish. This process requires the steel to be thoroughly cleaned. A light coat of etching primer is then applied, approximately 5/1000 inch, followed by a top/base coat, approximately 7/1000 inch. The playing surface only receives a very thin layer of clear coat, approximately 3/1000 inch. It is important to control the thickness of the primer, top coat, and clear coat, and the thicknesses stated above are example values which may be varied about plus or minus 50%. If any of the layers are applied too heavily, the sound quality of the finished product will be less than optimal, and "dry" with little resonance. Other finishing processes include but are not limited to, powder coating, ceramic coating, and the like.

F. Tuning of the Pan

Tuning is the final step in completing a finished pan. Each note facet is worked with a series of hammers, manipulating the substrate material into a shape that will produce proper pitch/frequency, good timbre/sound quality and a good feel/responsiveness when the note is struck with a mallet. The craftsman/tuner generally uses a strobe tuner as a visual reference of the frequency. There are several brands of strobe tuners that are adequate to perform the task, including the preferred Peterson model strobe tuners. The pan is first hammered while resting on, for example, a custom bench, designed to accommodate the particular diameter of pan being tuned. This process is referred to as "bench tuning". After the pan is bench tuned, hangers are added and the pan receives "final tuning" while suspended on, for example, a custom pan stand.

The note facets on hand crafted pans vary from drum to drum, rendering it difficult to develop a standard repeatable system of tuning. The note facets on current hand crafted pans are also undersized, as discussed above. The mechanization process provided herein allows for a repeatable system of tuning since each piece of a particular size and design is substantially identical. Each note facet for any particular frequency will not only be the same size from drum to drum, but is also a more optimal shape and size permitting the craftsman to achieve success quickly and on every note. This repeatability not only speeds the tuning process, but also allows for rapid training of many tuners, in order to keep pace with the growing demand for pans.

The process developed for mechanization and mass production of tunable pans as described herein has yielded many benefits and advantages, as discussed above, over ordinary pans hand crafted from industrial containers. It allows use of an appropriate diameter bowl to accommodate a desired range of notes as well as more optimal note facet sizes and shapes. This coupled with the options for attaching the desirable length sidewall or skirt, have made it possible to produce a high quality durable pan musical instrument lacking and overcoming many of the problems found in traditional pans. The male/female die set produces a precision pan that is consistent from part to part, offering repeatability and simplifying the training of qualified tuners. The stamping process has also eliminated up to about ninety percent of the time required for hand crafting a pan. This allows for a product readily available to meet market demand, and the ability to offer the marketplace a quality pan at an affordable price.

Additional embodiments within the scope of the invention will be appreciated by those of skill in the art. While embodiments of the present invention have been shown and described, various modifications may be made without departing from the spirit and scope of the present invention, and all such modifications and equivalents are intended to be within the scope of the appended claims.

EXAMPLES

The following Examples serve to illustrate the present invention and are not intended to limit its scope in any way.

Example 1

One Piece Powder Coated Jumbie Jam™ Beginner's Pan

The following process produced a 15.75" diameter Pan comprising eight note facets with a 2.5" skirt length, an example of which is shown in FIG. 10. This particular pan is of the one piece construction referred to above. The skirt and head were continuously formed from one piece of material. The eight notes are G4, A4, B4, C5, D5, E5, F#5, and G5. The numerals following the pitch letter refer to the octave of that pitch. The eight note facets are in the shape of a pseudo ellipse (a sphere intersecting a plane), G4 being the largest and G5 being the smallest. They are arranged starting at six o'clock going clockwise around the circumference of the bowl in the following manner: G4, B4, D5, A4, C5, E5 with the F#5 and G5 near the center of the bowl.

The process begins with a 0.034×22×22 inch square of cold rolled steel containing approximately 0.09% carbon, 0.011% or less sulfur, and a hardness rating of RB 52 or higher. The male/female die set was loaded with the sheet of steel into a one hundred fifty ton industrial press. The appropriate pressure and cycle time required were set. The press cycled for approximately 2 minutes. The stamped blank was removed from the press. The blank was then cleaned, removing any lubricant and/or debris. A hole was drilled on either side of the rim to accommodate the hangers. The blank was then suspended through one of the drilled holes. The desired color of powder coating material was applied and baked onto the blank. Hangers were attached and the pan was suspended on a stand. The pan was finish tuned while suspended on the stand.

Example 2

Welded Solid Hoop Chrome Plated Lead Pan

The following process produces a 26.75" diameter pan containing twenty nine note facets with a 6.5" skirt length, an example of which is shown in FIG. 5. This particular pan is a three piece construction as described above. The skirt and head are continuously welded to the edge of a ⅜×⅜ inch square rod of steel bent into a circular hoop. The twenty nine notes are C4, C#4, D4, Eb4, E4, F4, F#4, G4, G#4, A4, Bb4, B4, C5, C#5, D5, Eb5, E5, F5, F#5, G5, G#5, A5, Bb5, B5, C6, C#6 D6, Eb6, and E6. The twenty nine note facets are in the shape of a pseudo ellipse (a sphere intersecting a plane), C4 being the largest and E6 being the smallest. They are arranged in three circles around the circumference of the bowl. These three rings of notes are referred to as rim notes, middle ring of notes, and interior notes. The rim notes starting at six o'clock going clockwise are C4, F4, Bb4, Eb4, G#4, C#4, F#4, B4, E4, A4, D4, and G4. The middle ring of notes starting at six o'clock going clockwise are C5, F5, Bb5, Eb5, G#5, C#5, F#5, B5, E5, A5, D5, and G5. The interior notes starting at six o'clock going clockwise are C6, Eb6, C#6, E6, and D6.

The process begins with a 0.057×30×30 inch square of cold rolled steel containing approximately 0.09% carbon, 0.011% or less sulfur, and a hardness rating of RB 55 or higher. The male/female die set is loaded with the sheet of steel into an industrial stamping press. The appropriate pressure and cycle time required is set. The press cycles for approximately 2 minutes. The stamped blank is removed from the press. The blank is then cleaned, removing any lubricant and/or debris. The ⅜×⅜ inch bar stock is rolled into a 26.75" hoop. The preformed head is welded to the inside edge of the hoop. A piece of 0.032 inch thick cold rolled steel is rolled into a 6.5" deep cylinder to produce the skirt/sidewall, which is welded to the outside edge of the hoop. Holes are drilled on either side of the rim to accommodate the hangers. The material is annealed by baking at 650 degrees Fahrenheit for approximately five minutes. The entire piece is polished and buffed to achieve desired shine, then cleaned to remove polishing and buffing compound. The twenty nine note facets are bench tuned to the proper frequency, including appropriate octaves and harmonics. The unit is then placed in a custom built chroming rack, wherein a thin coat of nickel, approximately 7/1000 inch, is applied, followed by a thin coat of chrome, approximately 3/1000 inch. The hangers are attached, and the pan is suspended on the stand for finish tuning.

Example 3

Crimped Painted Double Second Two Pan Set

The following process produces a set of two 26.75" diameter pans containing sixteen note facets each (for a total of thirty two note facets for the two drum instrument), an example of which is shown in FIG. 6, each with a 10.5" skirt length. This particular Pan is a two piece construction. The skirt and head are crimped together. The thirty two notes are F3, F#3, G3, G#3, A3, Bb3, B3, C4, C#4, D4, Eb4, E4, F4, F#4, G4, G#4, A4, Bb4, B4, C5, C#5, D5, Eb5, E5, F5, F#5, G5, G#5, A5, Bb5, B5, and C6. The larger note facets, from F3 to D5, are in the shape of a pseudo ellipse (a sphere intersecting a plane), F3 being the largest and D5 being the smallest. The smaller interior note facets from Eb5-C6 are circular. The complete range of notes is split onto two drums with two rings of notes and two notes next to each other in the center of each drum. These two rings of notes are referred to as rim notes and middle ring of notes. The two notes near the center are referred to as interior notes. The rim notes of the right drum starting at six o'clock going clockwise are F3, F4, C#4, G3, B3, Eb4, and A3. The middle ring of notes starting at six o'clock going clockwise are A4, G5, F5, C#5, G4, B4, and Eb5. The two interior notes are A5 and B5. The rim notes of the left drum starting at six o'clock going clockwise are F#3, F#4, D4, G#3, C4, E4 and Bb3. The middle ring of notes starting at six o'clock going clockwise are Bb4, G#5, F#5, D5, G#4, C5, and E5. The two interior notes are Bb5 and C6. The two drums together make up one instrument.

The process begins with a 0.054×28×28 inch square of cold rolled steel containing approximately 0.09% carbon, 0.011% or less sulfur, and a hardness rating of RB 55 or higher. The male/female die set is loaded with the sheet of steel into a stamping press. The appropriate pressure and cycle time required is set. The press cycles for approximately 2 minutes. The stamped blank is removed from the press. The blank is then cleaned, removing any lubricant and/or debris. This process is repeated for the second drum in the set. Two pieces of 0.032 thick cold rolled steel are rolled into a 10.5" deep cylinder to produce the skirt/sidewall. The sidewall cylinders are crimped, each to one of the preformed heads using a set of rollers and a crimping die. Holes are drilled on either side of the rims to accommodate the hangers. The material is annealed by baking at 650 degrees Fahrenheit for approximately five minutes. The pans are cleaned to remove any lubricant and debris. Each of the thirty two note facets are bench tuned to the proper frequency, including appropriate octaves and harmonics. A thin coat of etching primer is sprayed on all surfaces. A thin layer of color of choice base/top coat is sprayed on only the sidewalls. The playing surface and the bottoms of the pans are sprayed with silver metallic paint. A thin layer of clear coat, approximately 3/1000 inch, is applied to the playing surface only. Hangers are attached and the pans are suspended on the stands for finish tuning.

The present invention is not to be limited in scope by the specific embodiments described above, which are intended as illustrations of aspects of the invention. Functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited references are hereby incorporated by reference.

We claim:

1. A process for making a tunable pan musical instrument, comprising the step of:

stamping a substrate into a pan head in a press with a male die pressing into a female die to produce a desired bowl size and shape, and note shape and placement;

wherein the pan head has a thickness gradually increasing from the center outwards.

2. The method of claim 1 further comprising the step of attaching a sidewall to the pan head to produce a pan.

3. The method of claim 2 further comprising the step of finishing the pan.

4. The method of claim 3 further comprising the step of tuning the pan.

5. The method of claim 1 wherein the die is designed to produce a pan having at least one feature selected from the group consisting of optimal size, optimal shape, optimal note facet size, optimal note facet shape, and optimal note facet layout.

6. A pan produced by the process of claim 1.

* * * * *